US007036577B2

(12) United States Patent
Minamijima et al.

(10) Patent No.: US 7,036,577 B2
(45) Date of Patent: May 2, 2006

(54) UNDERGROUND WATER PUMPING DEVICE

(75) Inventors: Yoshiyuki Minamijima, Hiroshima (JP); Shigeyoshi Takahashi, Kitakami (JP); Shuichi Matsumura, Higashiosaka (JP); Toru Yamaguchi, Sendai (JP)

(73) Assignees: Nippon Kensetsu Kikai Shoji Co., Ltd., Tokyo (JP); Asahi Techno Corp., Kitakami (JP)

( * ) Notice: Subject to any disclaimer, the term of this patent is extended or adjusted under 35 U.S.C. 154(b) by 52 days.

(21) Appl. No.: 10/333,916

(22) PCT Filed: Jul. 31, 2001

(86) PCT No.: PCT/JP01/06608

§ 371 (c)(1),
(2), (4) Date: Sep. 22, 2003

(87) PCT Pub. No.: WO02/12637

PCT Pub. Date: Feb. 14, 2002

(65) Prior Publication Data

US 2004/0031603 A1 Feb. 19, 2004

(30) Foreign Application Priority Data

Aug. 2, 2000 (JP) ..... 2000-234035

(51) Int. Cl.
*E21B 43/12* (2006.01)

(52) U.S. Cl. ..... 166/68.5; 166/242.8; 166/236; 166/370

(58) Field of Classification Search ..... 166/242.8, 166/236, 264, 311, 369, 370, 74, 90.1, 67, 166/68.5
See application file for complete search history.

(56) References Cited

U.S. PATENT DOCUMENTS

| | | | | |
|---|---|---|---|---|
| 2,833,222 A * | 5/1958 | Hansen | 166/105.5 |
| RE33,102 E * | 10/1989 | Visser et al. | 166/267 |
| 5,271,467 A * | 12/1993 | Lynch | 166/370 |
| 6,305,473 B1 * | 10/2001 | Peramaki | 166/313 |

FOREIGN PATENT DOCUMENTS

| | | |
|---|---|---|
| EP | 775535 A2 * | 5/1997 |
| JP | 125539/1986 | 8/1986 |

(Continued)

*Primary Examiner*—David Bagnell
*Assistant Examiner*—Daniel P Stephenson
(74) *Attorney, Agent, or Firm*—Oblon, Spivak, McClelland, Maier & Neustadt, P.C.

(57) ABSTRACT

A groundwater pumping apparatus includes an outer tube, an inner tube, a shield member, a vacuum unit and a pump unit. The outer tube is buried in ground, and has a water-passing portion at its lower part. The inner tube has a substantially same length as the outer tube, and is placed in the outer tube such that the inner tube is spaced from the outer tube. The inner tube has a groundwater inlet at its bottom end, which is provided at a position lower than a top end of the water-passing portion. The shield member shields top ends of the outer tube and the inner tube. The vacuum unit reduces a pressure in the inner tube. The pump unit pumps groundwater that comes in the inner tube through the groundwater inlet.

8 Claims, 12 Drawing Sheets

FOREIGN PATENT DOCUMENTS

| | | | |
|---|---|---|---|
| JP | 5-156624 | | 6/1993 |
| JP | 7-197441 | | 8/1995 |
| JP | 07284753 | A * | 10/1995 |
| JP | 8-13463 | | 1/1996 |
| JP | 9-279974 | | 10/1997 |
| JP | 2000-27170 | | 1/2000 |
| WO | WO 9508043 | A1 * | 3/1995 |
| WO | WO 9820232 | A1 * | 5/1998 |

* cited by examiner

UNDERGROUND WATER PUMPING DEVICE

TECHNICAL FIELD

The present invention relates to a groundwater pumping apparatus for pumping groundwater to lower the groundwater level in the case of excavating ground at underground construction sites or performing ground improvement.

BACKGROUND ART

In the past, when excavating ground at underground construction sites or performing ground improvement, groundwater is pumped to lower the groundwater level. Thus, by pumping groundwater to lower the groundwater level, it is possible to reduce a water content in soils of ground at a desired location. As a result, the excavating operation or treatments for the excavated soils can be facilitated.

As a groundwater pumping apparatus, a deep-well apparatus is known from the past. For example, in a conventional deep-well apparatus shown in FIG. 11, a well 40 having a water-passing portion 41 (strainer), through which groundwater comes inside, is put in a boring 43 formed in ground 42. In addition, a pump 46 is placed in the well 40. A clearance between an inner wall of the boring 43 and an outer surface of the well 40 is filled with a filter material 45 such as coarse sand or pea gravel. Groundwater is drawn from the water-passing portion 41 in the well 40 by the aid of a hydraulic head drop between a water level in the well 40 and the natural water level, and then the collected groundwater is pumped by the pump 46.

However, since the hydraulic head drop between the water level in the well 40 and the natural water level is used to collect groundwater, the groundwater collecting capacity depends on gravity difference. For this reason, groundwater can not be collected under a condition of effectively lowering the groundwater level.

In addition, a vacuum deep-well apparatus is known, which has the capability of effectively lowering the groundwater level by placing a vacuum unit in the deep-well apparatus, and reducing a pressure in the well, is known. However, in this vacuum deep-well apparatus, there is a problem that when the groundwater level reaches a position lower than the top end of the water-passing portion, air is drawn together with groundwater in the well through the water-passing portion, so that the vacuum effect of the vacuum unit sharply deteriorates. Thus, it still has plenty of room for improvement from the point of stably providing the groundwater collecting/pumping operation.

On the other hand, as shown in FIG. 12, a groundwater pumping apparatus disclosed in Japanese Patent Early Publication No. 2000-27170 has a strainer device 48 at a lower end of a casing tube 47 buried in ground 42. This strainer device 48 is formed with a strainer tube 49 attached to the lower end of the casing tube 47, sand accumulator 50 formed at a lower end of the strainer tube 49, and an inner tube 51 attached to the strainer tube 49 in a concentric manner with the casing tube 47. The strainer tube 49 is attached such that an outer surface of the casing tube 47 is substantially flush with the outer surface of the strainer tube 49. A clearance 52 is made between the strainer tube 49 and the inner tube 51, and closed at its upper end by a blockage plate 53 placed at the lower end of the casing tube 47. A groundwater inlet 54 is formed in the inner tube 51 at a position lower than the top end of a water-passing portion 55 of the strainer tube 49. In addition, a pump 56 for pumping groundwater is placed in the inner tube 51. The top end of the casing tube 47 is closed by a cover 58. In FIG. 12, the numeral 57 designates a vacuum unit for reducing a pressure in the casing tube 47 connecting to the inner tube 51.

In the case of using this pumping apparatus, when the pressure in the casing tube 47 connecting to the inner tube 51 is reduced by use of the vacuum unit and the hydraulic head drop, groundwater is drawn from the water-passing portion 55 of the strainer tube 49 in the inner tube 51 through the clearance 52 and the groundwater inlet 54, and collected in the inner tube 51. The collected groundwater in the inner tube 51 is pumped by the pump 56. Even when the groundwater level is lower than the top end of the water-passing portion 55, no intrusion of air into the inner tube 51 is caused under a condition that the groundwater level is higher than the position of the groundwater inlet 54. Therefore, it is possible to prevent the deterioration of the vacuum effect by the air intrusion, which occurs in the vacuum deep-well apparatus described above.

However, in this groundwater pumping apparatus, it is necessary to place the strainer device at the lower end of the casing tube 47. Therefore, when a deep-well apparatus having poor groundwater collecting capability has already existed in ground 1, the groundwater collecting/pumping operation by use of the already-existing apparatus is stopped, and the pumping apparatus of JP 2000-27170 must be newly formed in ground 1 to restart the water collecting/pumping operation. Thus, there is a problem that the existing deep-well apparatus comes to naught, and constructions for a groundwater pumping apparatus having another structure become necessary.

Moreover, since the groundwater pumping apparatus of JP 2000-27170 has the structure that the strainer device 48 composed of the inner tube 51, the clearance 53 and the strainer tube 49 is placed under the casing tube 47, groundwater can be collected only through the strainer device 48 placed under the casing tube 47. Therefore, when groundwater is present in the vicinity of an upper part of the casing tube 47 due to stratum structure, it may not be effectively collected. In addition, in this pumping apparatus, when the groundwater level lowers to reach the groundwater inlet 54 of the inner tube 51, air is sharply drawn in the inner tube 51 in place of groundwater, so that the vacuum effect sharply deteriorates. For this reason, the pump 56 must be stopped until the groundwater level raises again. Subsequently, when the groundwater level is recovered, the pressure in the inner tube 51 is reduced to a required value by the vacuum unit 57 and the groundwater collecting/pumping operation is restarted by use of the pump 56. Thus, there is a case that a stable groundwater collecting/pumping operation can not be continuously carried out.

SUMMARY OF THE INVENTION

In view of the above problems, an object of the present invention is to provide a groundwater pumping apparatus having the capability of effectively performing a groundwater collecting/pumping operation with a refined configuration, and making effective use of an existing deep-well apparatus. Moreover, in the groundwater pumping apparatus of the present invention, even when groundwater is present in the vicinity of ground surface, it is possible to effectively provide the stable groundwater collecting/pumping operation. In addition, a passage for groundwater can be maintained by effectively carrying out a water injection in ground.

That is, the groundwater pumping apparatus of the present invention comprises:

an outer tube 3 buried in ground 1, which has a water-passing portion 2 at its lower part;

an inner tube 5 having substantially a same length as the outer tube and placed in the outer tube 3 so as to be spaced from the outer tube, the inner tube 5 having a groundwater inlet 7 at its bottom end, which is provided at a position lower than a top end of the water-passing portion 2;

a shield member 6 for shielding top ends of the outer tube 3 and the inner tube 5;

a vacuum means 8 for reducing a pressure in the inner tube; and a pump means 9 for pumping groundwater that comes in the inner tube 5 through the groundwater inlet 7.

When the pressure in the inner tube 5 is reduced by the vacuum means 8, groundwater comes in the clearance 4 from the water-passing portion 2 of the outer tube 3. Then, the groundwater flows into the inner tube 5 from the clearance 4 through the groundwater inlet 7 of the inner tube 5. The groundwater collected in the inner tube 5 is pumped by the pump means 9. In this case, when the groundwater level is lower than the top end of the water-passing portion 2, air comes into the clearance 4 through the water-passing portion 2. However, since the groundwater inlet 7 is placed at the position lower than the top end of the water-passing portion, the air that comes in the clearance 4 is collected in an upper region of the clearance, but can not come in the inner tube 5. Therefore, it is possible to prevent a deterioration of vacuum effects of the vacuum means 8, and efficiently carry out the groundwater collecting/pumping operation.

In addition, even when wells having various diameters such as wells formed by a deep-well method or a vacuum deep-well method, test well for investigating ground, and a recharge well, has already existed, it is possible to make effective use of these existing wells as the outer tube 3 because the outer tube 3 has substantially the same length as the inner tube 5. That is, the already-existing well can be recycled for the groundwater pumping apparatus of the present invention by inserting the inner tube 5 having substantially the same length as the outer tube 3 so as to make the clearance 4 between the inner tube and the already-existing well as the outer tube 3, shielding the top ends of the outer tube 3 and the inner tube 5 with the shield member 6, and placing the vacuum means 8 and the pump means 9.

In the groundwater pumping apparatus described above, it is preferred that the outer tube 3 has a plurality of water-passing portions formed in an axial direction of the outer tube. In this case, the efficiency of collecting groundwater can be further improved.

Additionally, in the groundwater pumping apparatus described above, it is preferred that the groundwater inlet 7 is formed in a bottom end surface of the inner tube 5 and placed at a position slightly higher than the bottom end of the outer tube 3, and the inner tube 5 has an air inlet 11 composed of at least one slit 22 for air vent having an elongate shape, and the slit is formed in a side surface of the bottom end of the inner tube so as to extend in an axial direction of the inner tube, and the air inlet 11 is formed to extend from the groundwater inlet to a position lower than the top end of said water-passing portion 2. During the pumping operation, a small amount of air comes in the inner tube 5 from the air inlet 11 before the groundwater level lowers to reach a level of the groundwater inlet 7, so that an internal pressure of the inner tube 5 slightly raises. By controlling the pumping amount by the pump means 9 in response to the pressure change in the inner tube 5, it is possible to prevent an abrupt decrease of groundwater, and avoid a situation that groundwater can not be pumped because a large amount of air suddenly flows in the inner tube from the groundwater inlet 7. In addition, since the air inlet 11 is provided by the elongate slit 22 extending in the axial direction of the inner tube 5, the amount of air flowing from the slit 22 into the inner tube 5 increases as the groundwater level lowers. Therefore, it is possible to accurately adjust the pumping amount according to the pressure change in the inner tube 5.

Moreover, in the groundwater pumping apparatus described above, it is preferred that groundwater inlet 7 is formed in a bottom end surface of the inner tube 5 and placed at a position slightly higher than the bottom end of the outer tube, and the inner tube 5 has an air inlet composed of a plurality of holes 23 for air vent, and the holes are formed in a side surface of the bottom end of the inner tube so as to be arranged in an axial direction of the inner tube, and the air inlet 11 is formed to extend from the groundwater inlet 7 to a position lower than the top end of the water-passing portion 2. During the pumping operation, a small amount of air comes in the inner tube 5 from the air inlet 11 composed of the plurality of holes 23 for air vent before the groundwater level lowers to reach a level of the groundwater inlet 7, so that an internal pressure of the inner tube 5 slightly raises. By controlling the pumping amount by the pump means 9 in response to the pressure change in the inner tube 5, it is possible to prevent an abrupt decrease of groundwater, and avoid a situation that groundwater can not be pumped because a large amount of air suddenly flows in the inner tube from the groundwater inlet 7. In addition, since the air inlet 11 is provided by the plurality of holes 23 for air vent formed in an axial direction of the inner tube, the amount of air flowing from the holes 23 for air vent into the inner tube 5 increases as the groundwater level lowers. Therefore, it is possible to accurately adjust the pumping amount according to the pressure change in the inner tube 5.

In the above-described groundwater pumping apparatus, it is also preferred that an aperture amount of a lower part of the air inlet 11 is larger than the aperture amount of its upper part. In this case, as the groundwater level lowers, the amount of air flowing into the inner tube 5 increases in a quadratic-function manner. Therefore, it is possible to accurately detect delicate fluctuations of the water level at the air inlet 11.

It is further preferred that the groundwater pumping apparatus described above comprises a pressure detecting means 12 for detecting the internal pressure of the inner tube, and a pumping-amount adjusting means 13 for adjusting a pumping amount. It is effective to provide the stable pumping operation without interruption.

It is also preferred that the groundwater pumping apparatus described above further comprises a pressure means 14 for increasing the pressure in the inner tube, and a water injection means 15 for carrying out a pressure injection of water in the inner tube. In this case, it is possible to clean clogging in a filter member 16 placed around the outer tube 3 and the water-passing portion 2, and provide a more effective groundwater collecting/pumping operation.

BEST MODE FOR CARRYING OUT THE INVENTION

The present invention is explained below in detail according to embodiments shown in the attached drawings.

Figure 1:
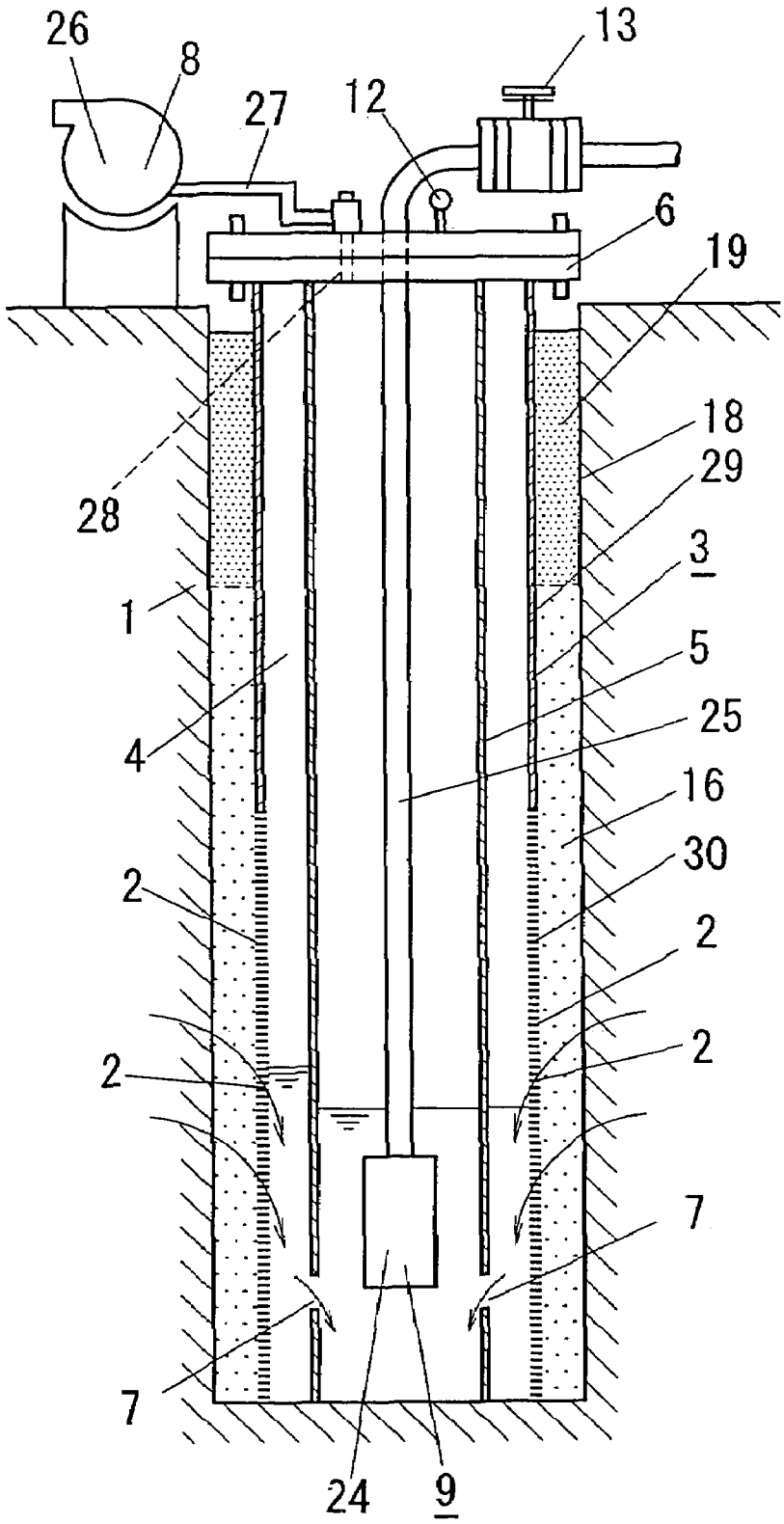
FIG. 1 is a schematic cross-sectional view of a groundwater pumping apparatus according to a first embodiment of the present invention.
Figure 2:
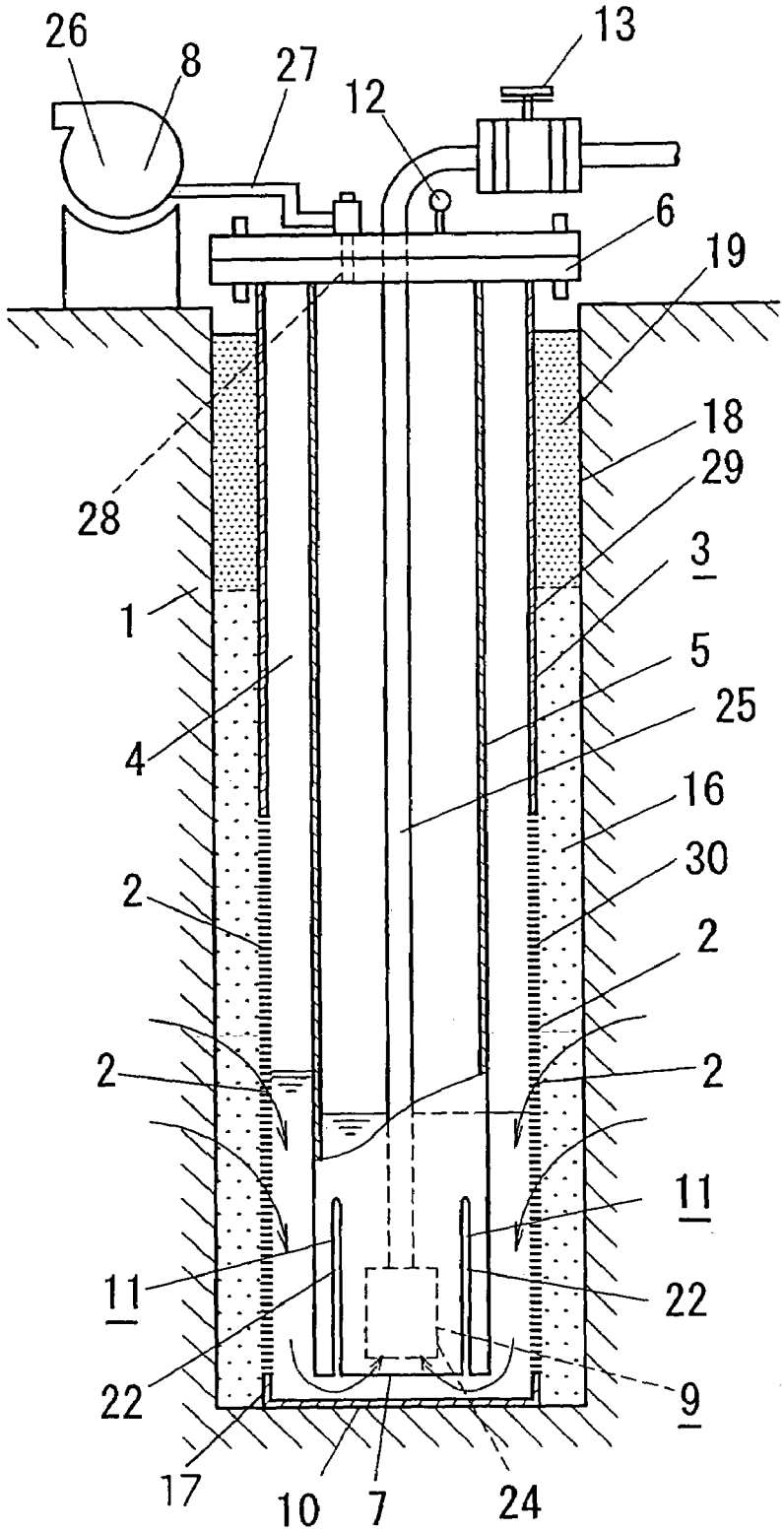
FIG. 2 is a schematic cross-sectional view of a groundwater pumping apparatus according to a second embodiment of the present invention.
Figure 3:
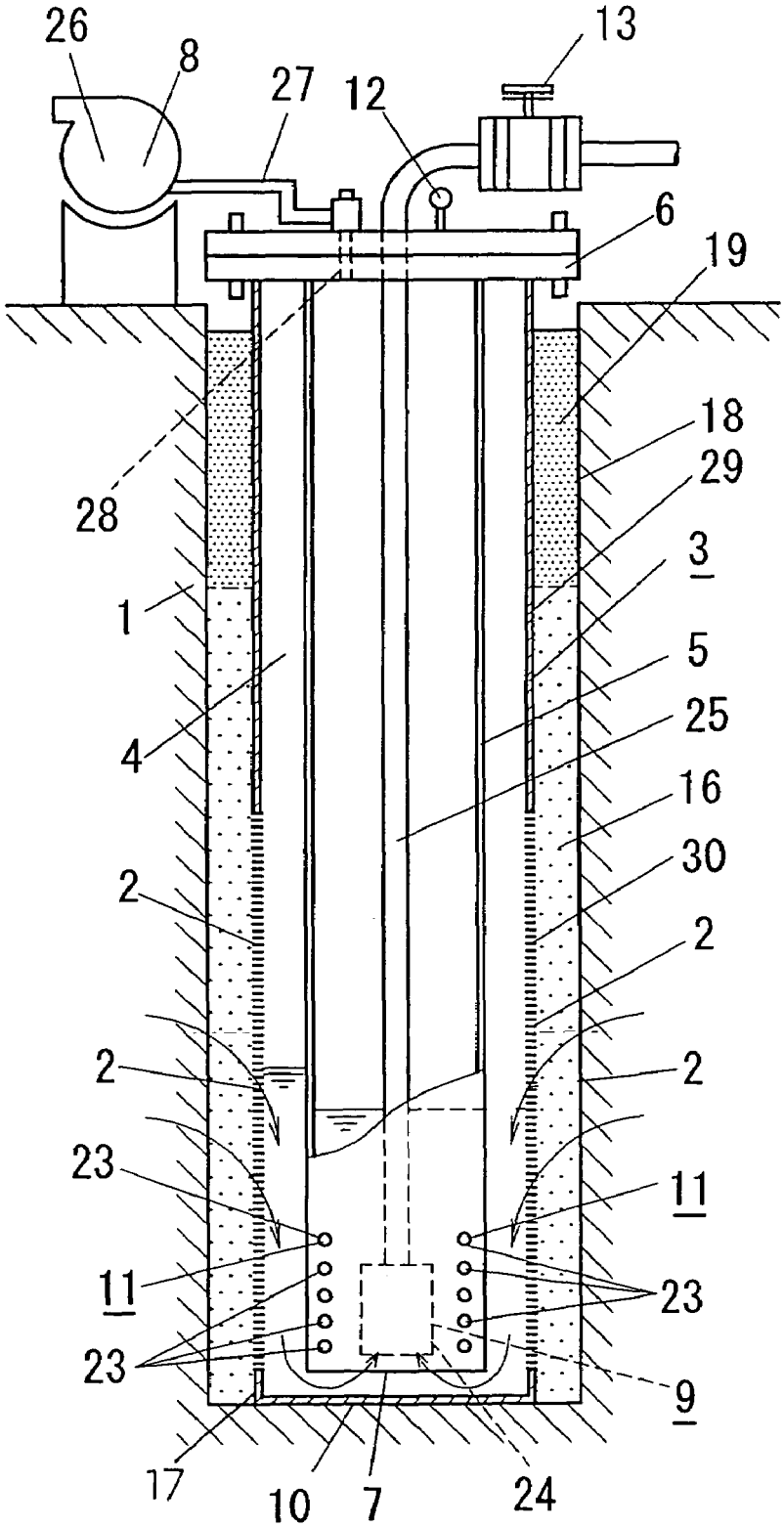
FIG. 3 is a schematic cross-sectional view of a groundwater pumping apparatus according to a third embodiment of the present invention.

As shown in FIG. 1, a groundwater pumping apparatus according to a first embodiment of the present invention is mainly composed of an outer tube 3 buried in ground 1, an inner tube 5 having substantially a same length as the outer tube 3 and inserted in the outer tube 3 through a clearance 4, a shield member 6 for shielding top ends of the outer tube 3 and the inner tube 5, a vacuum unit 8 for reducing a pressure in the inner tube 5, and a pump unit 9 for pumping groundwater collected in the inner tube 5.

The outer tube 3 has a water-passing portion 2 at its lower part at least. For example, a steel tube 29 having a strainer tube 30 at its lower end can be used as the outer tube 3. The strainer tube 30 is of a cylindrical shape having the same diameter as the steel tube 29, and has a structure that a steel wire is wound at a required interval to form crevices that function as the water-passing portion 2. Alternatively, a tube having a plurality of apertures that function as the water-passing portion 2 may be used as the strainer tube 30. That is, the water-passing portion 2 has a structure that groundwater can flow inside through the crevices. In the figure, the numeral 17 designates a sand accumulator placed at the bottom end of the strainer tube 30. The bottom of the sand accumulator 17 provides the bottom end 10 of the outer tube 3.

The inner tube 5 is formed by a steel tube having substantially the same length as the outer tube 3. The bottom end surface of the inner tube 5 is entirely opened to function as a groundwater inlet 7. This inner tube 5 is concentrically inserted in the outer tube 3 to be spaced from the outer tube 3 by the clearance 4. The groundwater inlet 7 of the inner tube 5 is provided at a position slightly higher than the bottom end 10 of the outer tube 3, and at the position lower than the top end of the water-passing portion 2.

Groundwater pumping apparatuses of the present invention shown in FIGS. 2 to 7 are characterized in that an air inlet 11 is formed in a side surface of the bottom end of the inner tube 5 at a position higher than the groundwater inlet 7. In the groundwater pumping apparatus of the second embodiment shown in FIG. 2, a plurality of slits 22 for air vent each having an elongate shape are formed in the side surface of the bottom end of the inner tube 5 to extend in the axial direction of the inner tube. The slits 22 have a length from the groundwater inlet 7 to a position lower than the top end of the water-passing portion 2. The slits 22 provide the air inlet 11. Moreover, in the pumping apparatus of the third embodiment shown in FIG. 3, a plurality of holes 23 for air vent are formed in the side surface of the bottom end of the inner tube, and arranged in the axial direction of the inner tube. This arrangement of the holes 23 has a length from the groundwater inlet 7 to a position lower than the top end of the water-passing portion 2. The holes 23 provide the air inlet 11.

Figure 4:
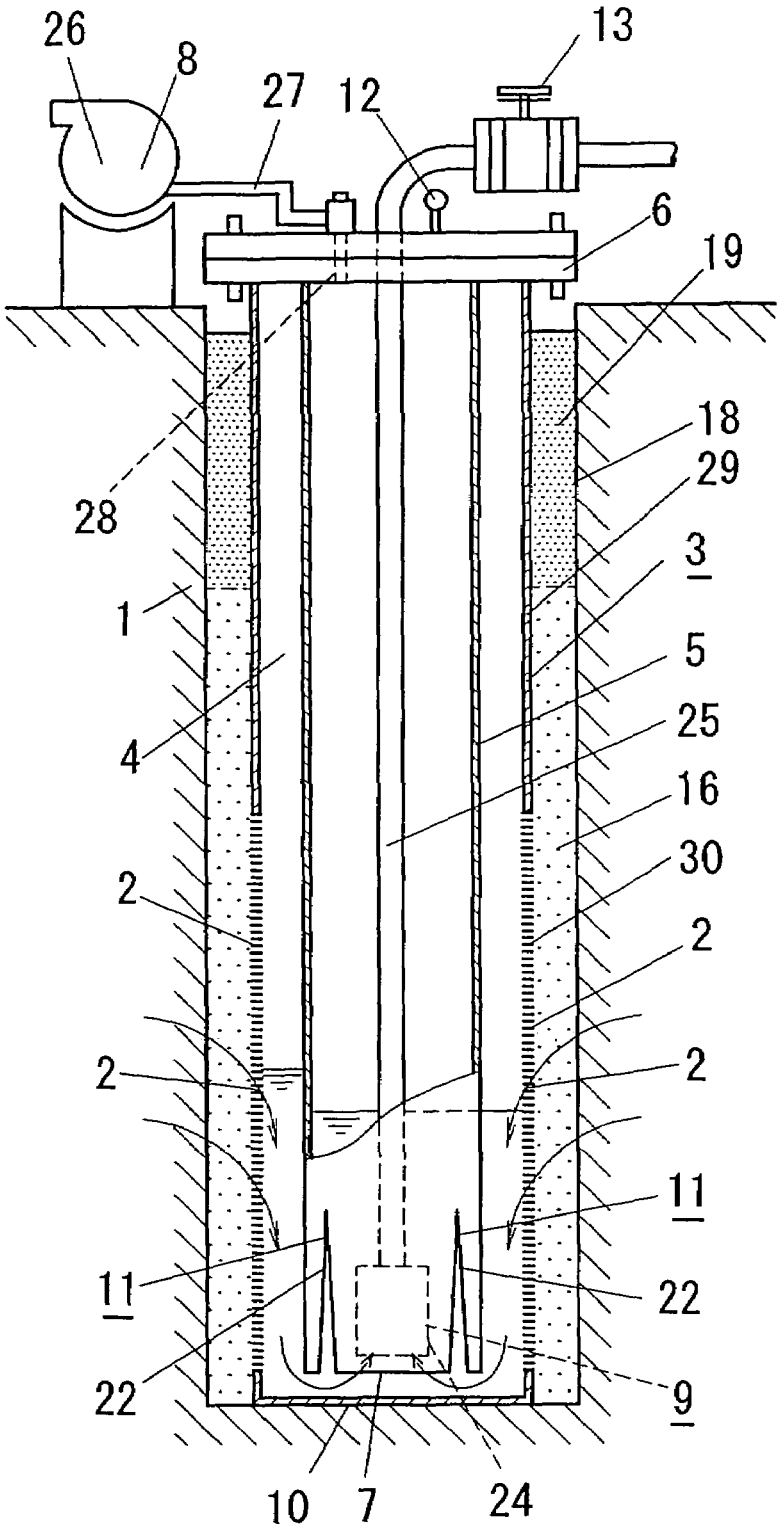
FIG. 4 is a schematic cross-sectional view of a groundwater pumping apparatus according to a modification of the second embodiment.
Figure 5:
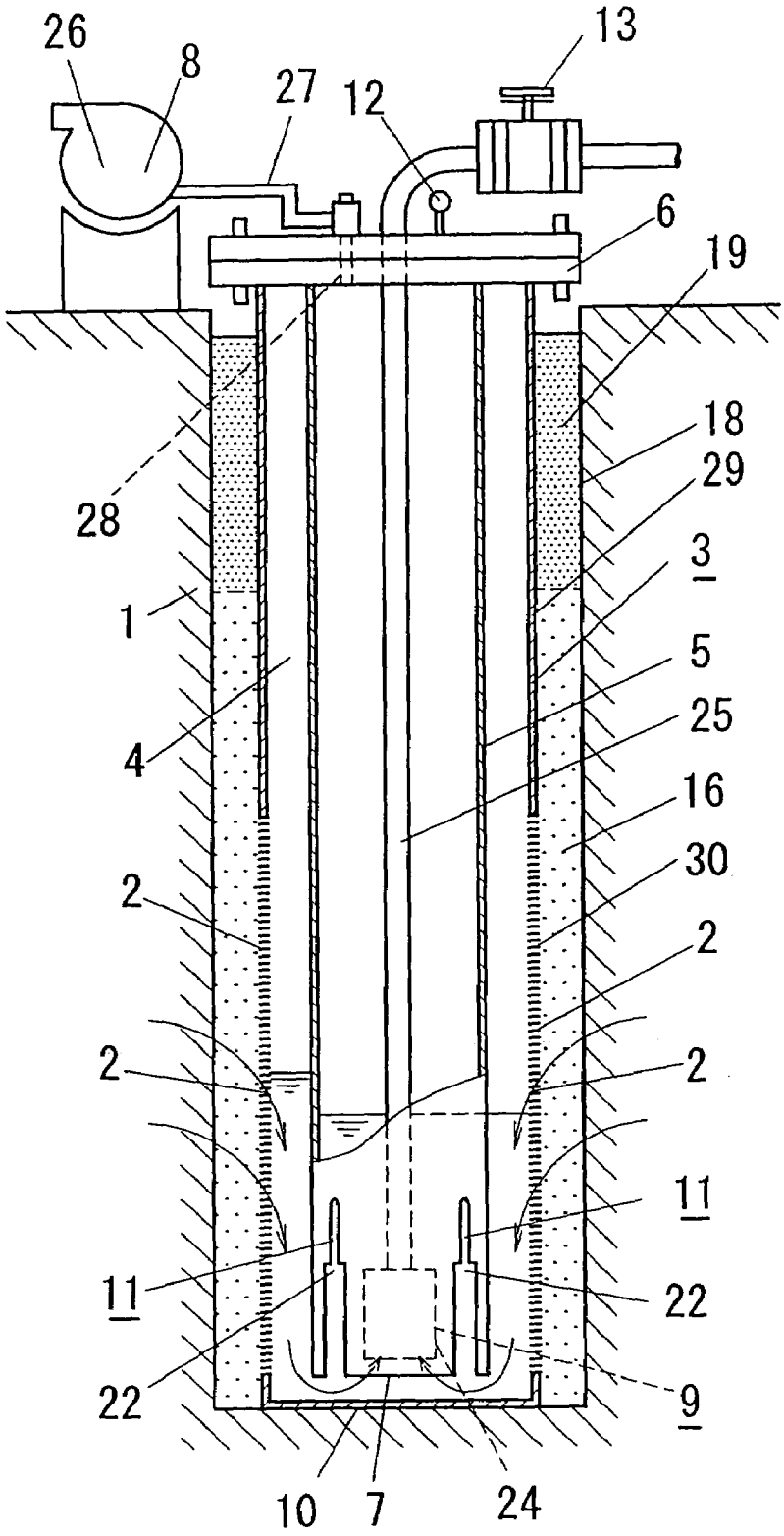
FIG. 5 is a schematic cross-sectional view of a groundwater pumping apparatus according to another modification of the second embodiment.
Figure 6:
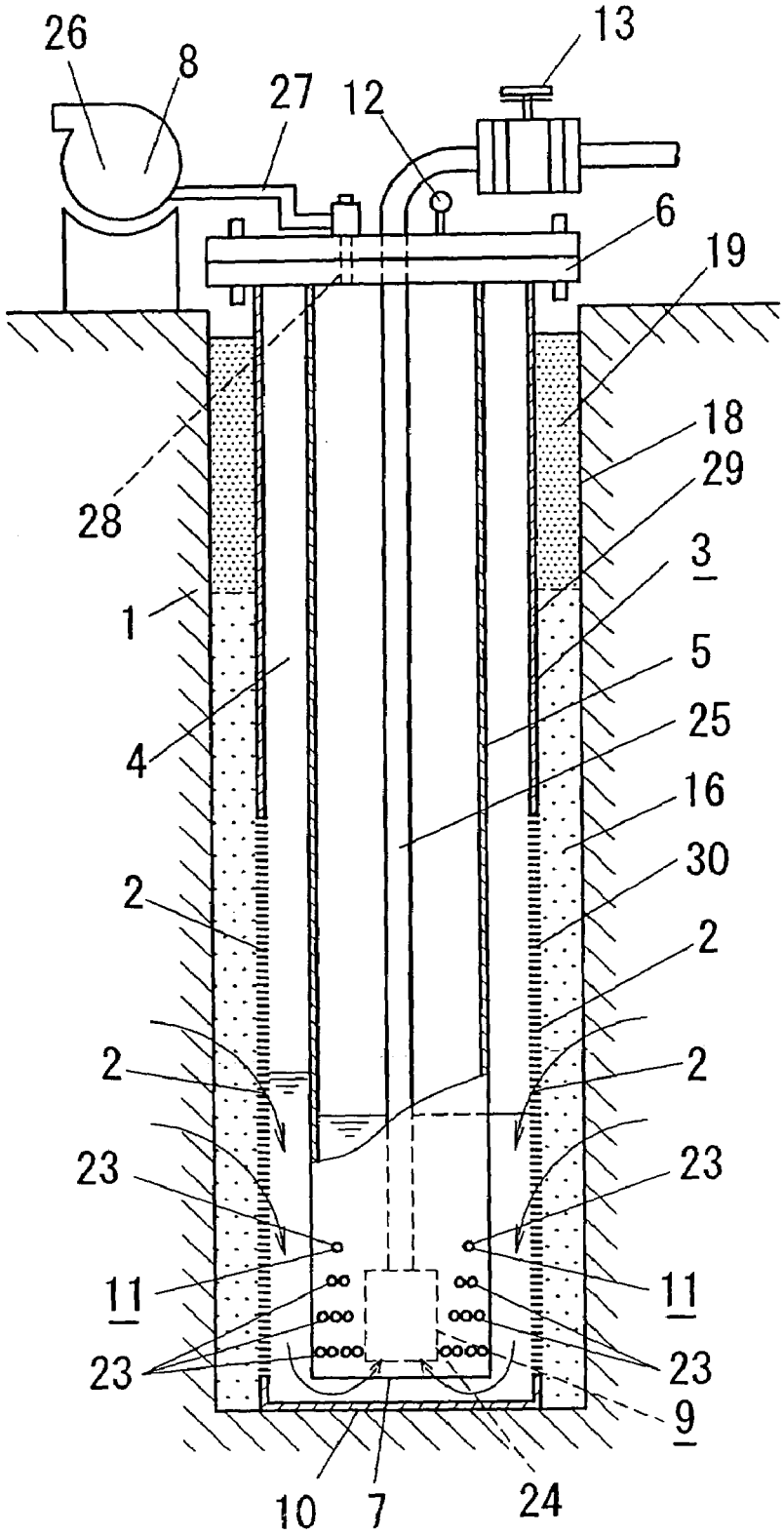
FIG. 6 is a schematic cross-sectional view of a groundwater pumping apparatus according to a modification of the third embodiment.
Figure 7:
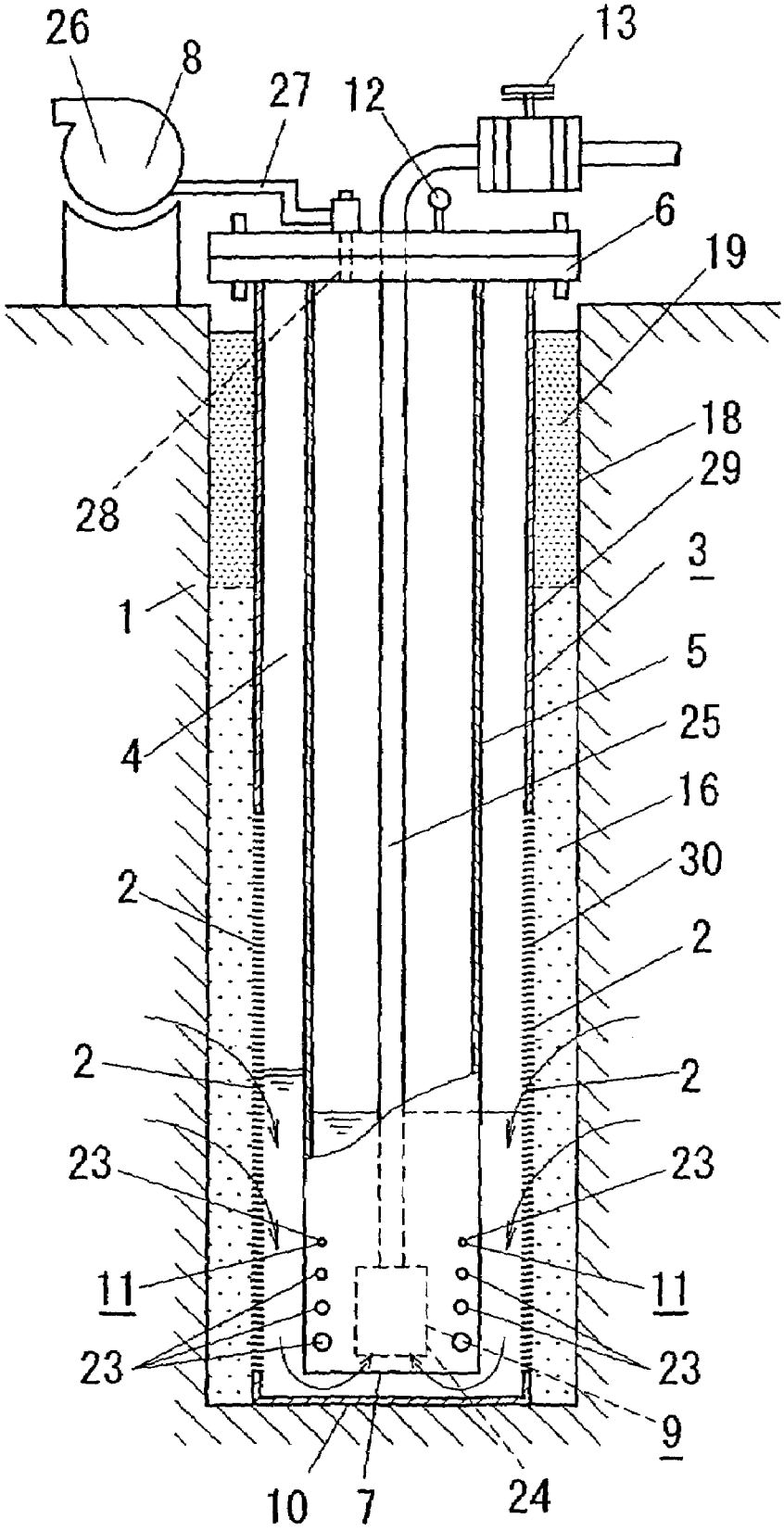
FIG. 7 is a schematic cross-sectional view of a groundwater pumping apparatus according to another modification of the third embodiment.

In addition, modifications of the pumping apparatus of the second embodiment are shown in FIGS. 4 and 5, and modifications of the pumping apparatus of the third embodiment are shown in FIGS. 6 and 7. In each of these pumping apparatuses, it is shown that the air inlet 11 has a larger aperture area at its lower part than its upper part. That is, in the groundwater pumping apparatus of FIG. 4, each of the slits 22 is of a triangular shape that tapers down toward the upper part of the inner tube. Additionally, in the groundwater pumping apparatus of FIG. 5, each of the slits 22 is composed of an upper slit having a narrow width and a lower slit having a wide width. On the other hand, in the groundwater pumping apparatus of FIG. 6, a plurality of holes 23 for air vent are formed such that the number of the holes 23 for air vent increases toward the bottom side of the inner tube. In addition, in the groundwater pumping apparatus of FIG. 7, the holes 23 for air vent are formed such that diameters of the holes 23 for air vent increase toward the bottom side of the inner tube. In the case that the aperture area of the lower part of the air inlet 11 is larger than the aperture area of the upper part thereof, an embodiment other than FIGS. 4 to 7 may be adopted to obtain the larger aperture area of the air inlet 11 at the lower part than the upper part.

The top ends of the outer tube 3 and the inner tube 5 are shielded by the shield member 6 such as a cover. A pump 24 is disposed as the pump unit 9 in the vicinity of the groundwater inlet 7 at the bottom end of the inner tube 5. A pump tube 25 connected to the pump 24 air-tightly passes through the shield member 6 and extends outside. At the outside of the shield member 6, a pumping-amount adjusting unit 13 including a flow-amount regulating valve is placed.

A ventilation slot 28 is formed in the shield member 6. A vacuum pump 26 that is the vacuum unit 8 is connected to this ventilation slot 28 through a joint pipe 27. By activating the vacuum pump 26, the internal pressure of the inner tube 5 can be reduced. In the figure, the numeral 12 designates a pressure detecting unit such as a pressure meter for detecting the pressure in the inner tube 5.

The groundwater pumping apparatus having the above configuration is used to lower the groundwater level by pumping groundwater in the case of excavating ground 1 at underground construction sites, or performing ground improvement. That is, a boring 18 having a larger diameter than the outer tube 3 is initially formed in ground 1 at a location intended for pumping groundwater. Then, the outer tube 3 of the groundwater pumping apparatus is inserted into the boring 18. At this time, a filter material 16 such as coarse sand or pea gravel is charged in a space between an inner wall of the boring 18 and the peripheral surface of the outer tube 3. In addition, a sealing material 19 such as cement mortar or bentonite mortar is charged in a space between the inner wall of an upper part of the boring 18 and the peripheral surface of an upper part of the outer tube 3. In place of the sealing material 19, another sealing means may be used. For example, a balloon may be put between the inner wall of the upper part of the boring 18 and the peripheral surface of the upper part of the outer tube 3, and inflated to seal therebetween.

In the case of pumping groundwater, when the internal pressure of the inner tube 5 is reduced by the vacuum unit 8, groundwater flows in the clearance 4 through the water-passing portion 2 of the outer tube 3. In addition, the groundwater forcedly flows in the inner tube 5 from the clearance 4 through the groundwater inlet 7 formed in the bottom end of the inner tube 5. The collected groundwater in the inner tube 5 is pumped by activating the vacuum pump of the vacuum unit 9. In this case, when the groundwater level lowers to reach the top end of the water-passing portion 2, air existing in ground 1 comes into the clearance 4 from the water-passing portion 2. However, since the groundwater inlet 7 of the inner tube 5 is provided at a position lower than the top end of the water-passing portion 2, air is accumulated in an upper part of the clearance 4, so that the air can not comes in the inner tube 5. Therefore, only groundwater flows in the inner tube 5 from the groundwater inlet 7. At this time, a small amount of groundwater can flow in the inner tube 5 from the air inlet 11 provided at the position lower than the top end of the water-passing portion 2. Thus, even when the groundwater level lowers to reach the top end of the water-passing portion 2, it is possible to prevent the inconvenience that vacuum effects of the vacuum unit 8 deteriorates by a flow of air in the inner tube 5.

In addition, when the groundwater level further lowers to reach the top end of the air inlet 11 provided at the position lower than the top end of the water-passing portion 2, part of the air that came in the clearance 4 from the water-passing portion 2 can flow in the inner tube 5 from the upper part of the air inlet 11, but not flow in the inner tube 5 from the groundwater inlet 7. In this case, though the small amount of air flows in the inner tube 5 to slightly increase the internal pressure of the inner tube 5, the vacuum effects of the vacuum unit 8 does not sharply deteriorate, and the flow of groundwater in the inner tube 5 from the groundwater inlet 7 can be stably maintained. Therefore, it is possible to stably continue the groundwater pumping operation by the pumping unit 9.

When the groundwater level reaches the air inlet 11, and the groundwater pumping operation is continued by the pumping unit 9 at a pumping rate that is the same as the pumping rate before the decrease of groundwater level, the groundwater level sharply lowers, so that there is a fear that the groundwater level lowers to reach the groundwater inlet 7 that is the bottom opening of the inner tube 5. When the groundwater level reaches the groundwater inlet 7, a large amount of air suddenly flows in the inner tube 5 from the groundwater inlet 7 that has a much larger aperture area than the air inlet 11 to rapidly increase the internal pressure of the inner tube 5. This leads to a considerable decrease in the flow amount of groundwater in the inner tube 5 due to a deterioration of the vacuum effects. In such a case, the pumping operation using the pumping unit 9 is stopped, and it is necessary to wait a rise in the groundwater level. Then, the interior of the inner tube 5 is maintained again under a reduced pressure by use of the vacuum unit 8, and the groundwater pumping operation is restarted by the pumping unit 9. Thus, there is a fear of causing an interruption of the pumping operation.

Figure 8:
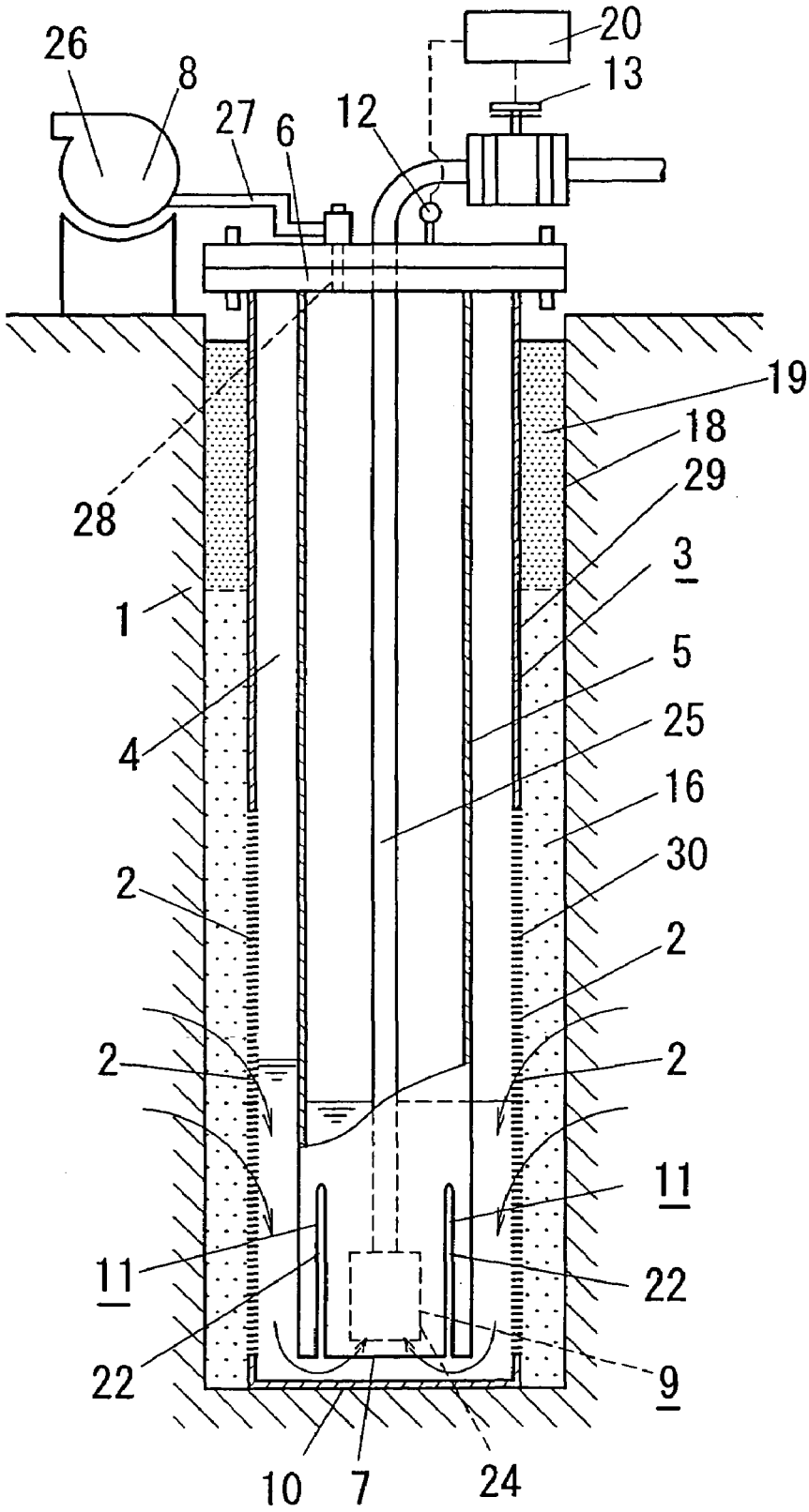
FIG. 8 is a schematic cross-sectional view of a groundwater pumping apparatus according to a further modification of the second embodiment.

In the present invention, when the groundwater level lowers, and the small amount of air flows in the inner tube 5 from the air inlet 11 to increase the internal pressure of the inner tube 5, the increase in the internal pressure of the inner tube 5 is detected by the pressure detecting unit 12. When the internal pressure of the inner tube 5 reaches a predetermined value or more, the pumping amount is reduced by the flow-amount regulating valve of the pumping-amount adjusting unit 13. As a result, it is possible to continue the groundwater pumping operation by the pumping unit 9 without interruption. The pumping amount may be controlled by checking a detected value by the pressure detecting unit 12 with the naked eye, and adjusting the flow-amount regulating valve by manual operation. Alternatively, as shown in the groundwater pumping apparatus shown in FIG. 8, a signal detected by the pressure detecting unit 12 is output to a control unit 20, and the flow-amount regulating valve may be controlled according to a control signal from the control unit 20 to adjust the pumping amount.

As described above, when the pumping amount is controlled by the pumping-amount adjusting unit 13 according to the pressure change in the inner tube 5 detected by the pressure detecting unit 12, and the air inlet 11 is formed with the plurality of slits 22 or holes 23 for air vent, as shown in FIGS. 2 to 7, the amount of air flowing in the inner tube 5 through the air inlet 11 increases as the groundwater level lowers. The adjustment of the pumping amount by the pumping-amount adjusting unit 13 is repeated until the groundwater level becomes stable, while detecting the pressure change in the inner tube 5 caused by this air flow by the pressure detecting unit 12. When the internal pressure of the inner tube 5 becomes stable, it is regarded that the groundwater level reaches a stable state, and the adjustment of the pumping amount is stopped to continue the groundwater pumping operation at a stable pumping rate. That is, it is possible to avoid a situation that the adjustment of the pumping amount by the pumping-amount control unit 13 is not sufficient, and the groundwater level continuously lowers to reach the groundwater inlet 7, and perform the groundwater pumping operation at the stable pumping rate without interruption.

In addition, in the case of pumping a large amount of groundwater by the pumping unit 9 having high functions, the internal pressure of the inner tube 5 changes by a small amount of air flowing in the inner tube 5 when the groundwater level lowers to reach the air inlet 11, as in the case described above. The pressure change in the inner tube 5 is detected by the pressure detecting unit 12, and the pumping-amount adjusting unit 13 controls the pumping amount according to the output from the pressure detecting unit 12. As the amount of groundwater decreases, fluctuations of the groundwater level flowing in the inner tube from the air inlet 11 become large. For this reason, the amount of air that comes in the inner tube from the air inlet 11 often becomes unstable. In such a case, as shown in FIGS. 4 to 7, it is preferred to form the air inlet 11 having the larger aperture area at its lower part than its upper part. Since the inflow amount of air increases in a quadratic-function manner as the groundwater level lowers, it is possible to more accurately detect the fluctuations of the groundwater level at the air inlet 11. The accurate detection of an increase in pressure in the inner tube 5 provides a stable pumping operation by the pumping unit 9.

By the way, in the present invention, it is possible to recycle the existing wells having various diameters such as wells formed in ground 1 by the conventional deep-well method, wells formed by the conventional vacuum deep-well method, test wells for ground investigation, or recharge wells, for the groundwater pumping apparatus of the present invention.

For example, as explained below, an already-existing well constructed by the deep-well method can be used for the pumping apparatus of the present invention. That is, in this case, the already-existing well is used as the outer tube 3 of the present invention. First, mortar or the like is injected into soils recharged in a space between the boring and the peripheral surface of an upper part of the existing well to seal the surrounding of the upper part of the existing well. Next, a pumping tube is pull out, and an inner tube 5 having a diameter smaller than the existing well and substantially the same length as the outer tube 3 is inserted in the outer tube 3. Subsequently, a pump is placed in the inner tube 5, and the top ends of the outer tube 5 and the inner tube 3 are shielded by the shield member 6. Finally, a vacuum unit 8 is set. Thus, the already-existing well can be used as the outer tube 3 of the groundwater pumping apparatus of the present invention.

Figure 9:
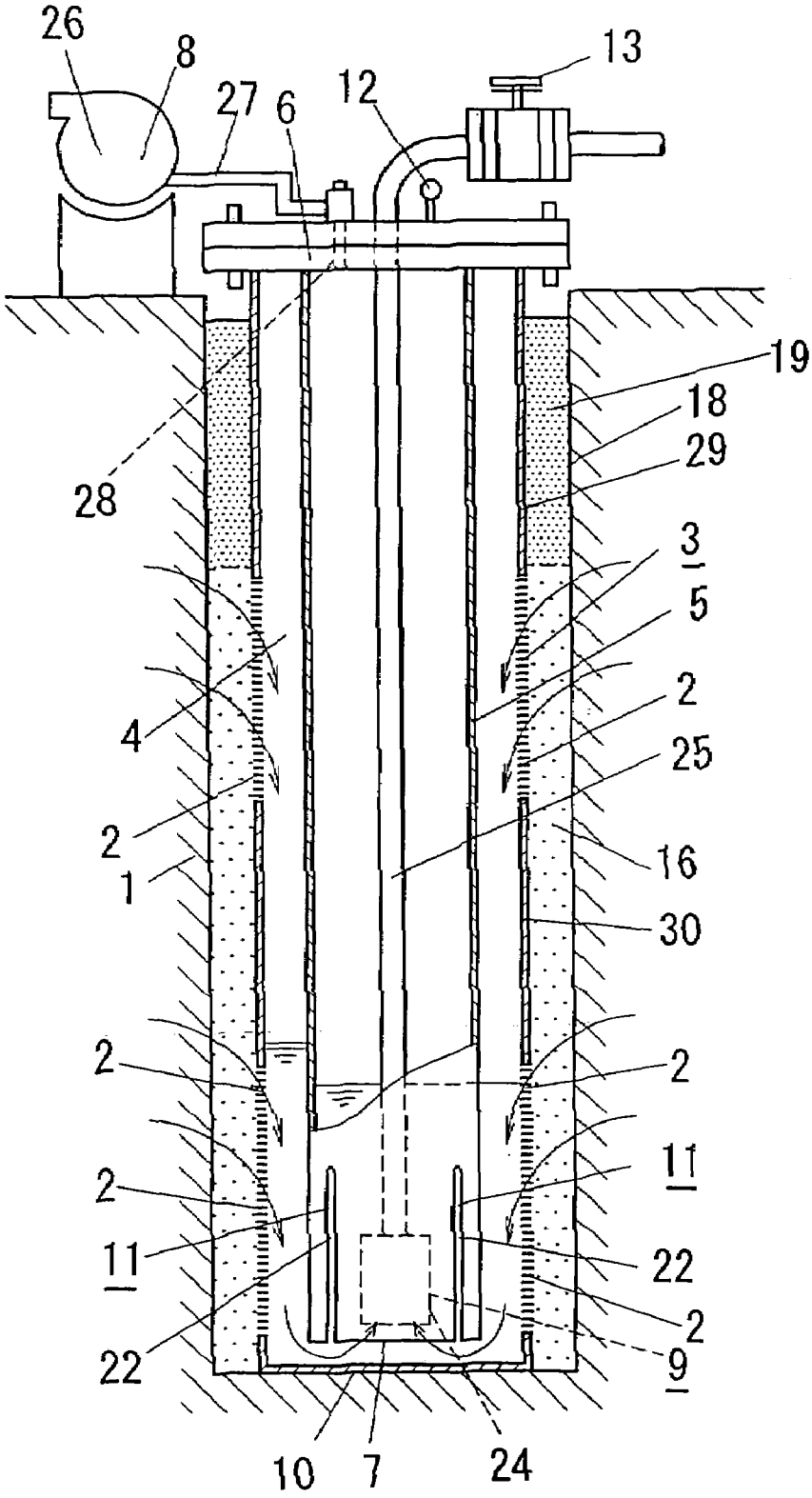
FIG. 9 is a schematic cross-sectional view of a groundwater pumping apparatus according to a fourth embodiment of the present invention.

FIG. 9 shows a groundwater pumping apparatus according to a fourth embodiment of the present invention. This pumping apparatus is characterized in that a plurality of water-passing portions 2 are formed in the axial direction of the outer tube 3. In this case, since groundwater can be collected at plural sites in the axial direction of the outer tube 3, it is possible to more efficiently perform the groundwater collecting operation. When forming the air inlet 11 in this pumping apparatus, the air inlet 11 is formed at a position lower than a top end of the lowermost one of the water-passing portions 2. As the configuration of the air inlet 11, the slits 22 or the holes 23 for air vent described above may be used. In addition, it is preferred that the air inlet 11 has a larger aperture area at its lower part than its upper part.

Figure 10:
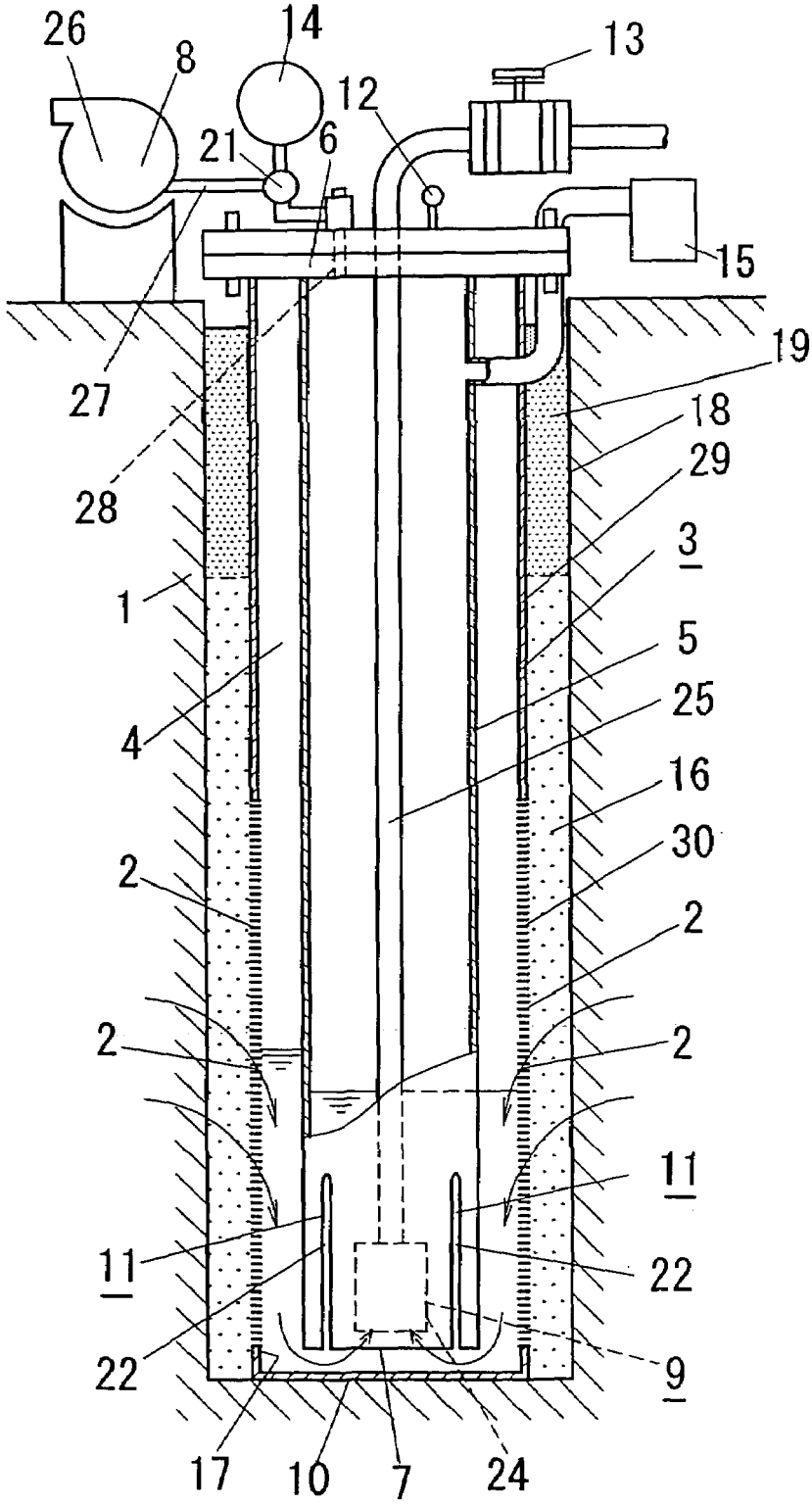
FIG. 10 is a schematic cross-sectional view of a groundwater pumping apparatus according to a fifth embodiment of the present invention.
Figure 11:
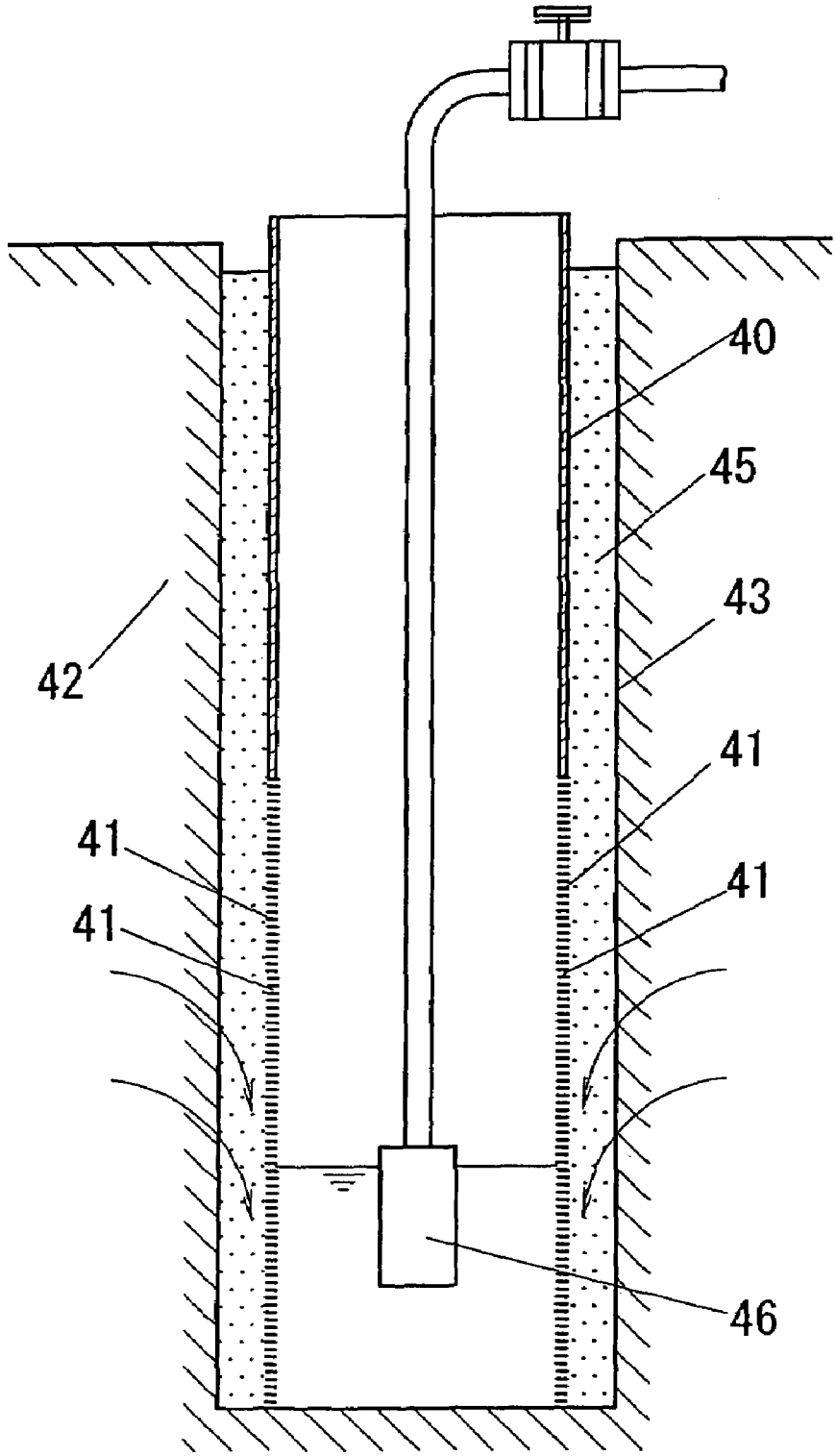
FIG. 11 is a schematic cross-sectional view of a conventional groundwater pumping apparatus.
Figure 12:
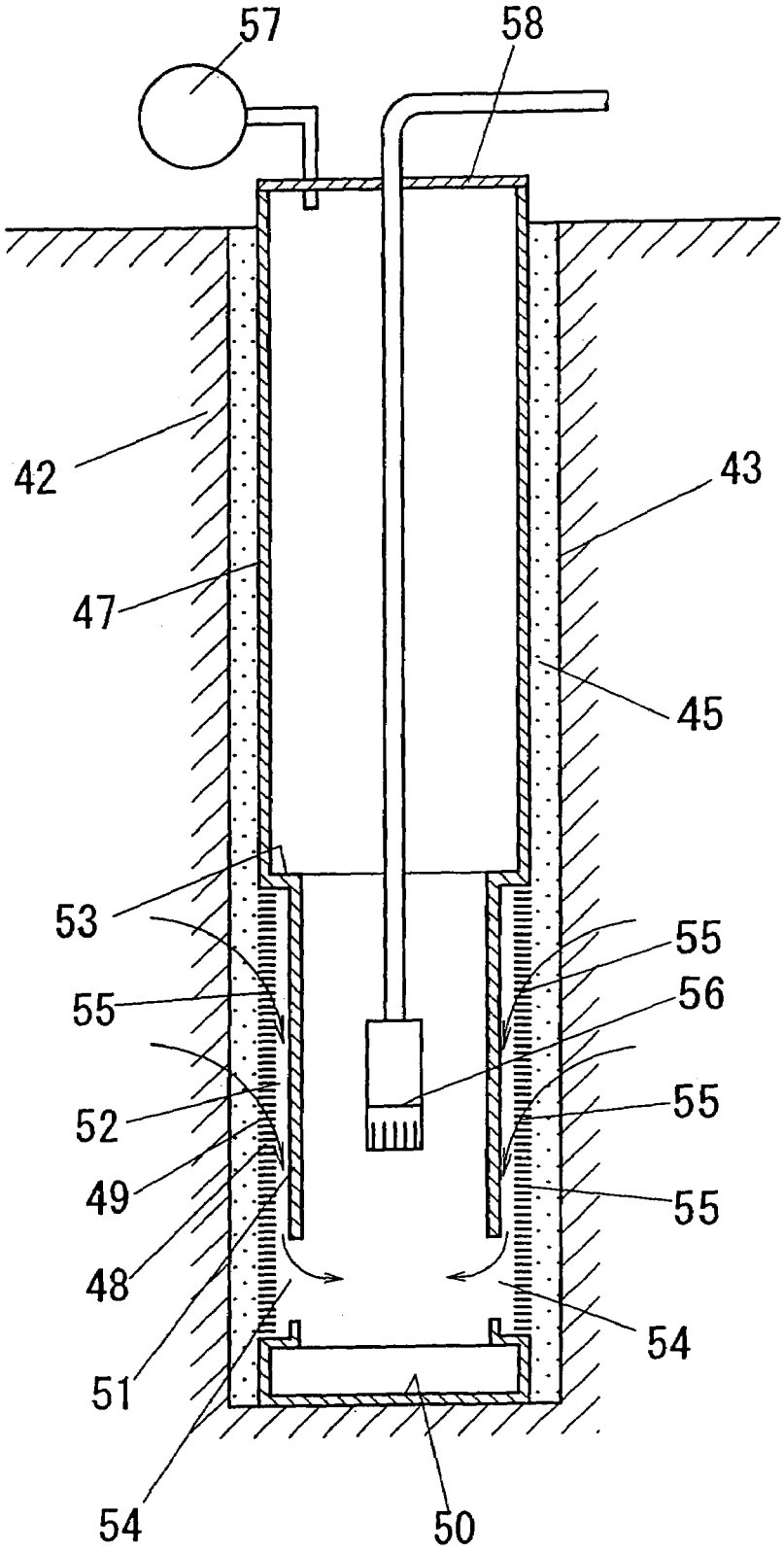
FIG. 12 is a schematic cross-sectional view of a groundwater pumping apparatus disclosed in Japanese Patent Early Publication No. 2000-27170.

FIG. 10 shows a groundwater pumping apparatus according to a fifth embodiment of the present invention. This pumping apparatus is characterized by further comprising a pressure unit 14 of increasing the internal pressure of the inner tube 5, and a water injection unit 15 for carrying out a pressure injection of water in the inner tube 5. In this embodiment, a vacuum pump 26 used as the vacuum unit 8 is connected to a connection tube 27, and a compressor used as the pressure unit 14 is connected to the connection tube 27 through a switch valve 21. The water injection unit 15 composed of a pressure pump is connected to the inner tube 5. The pressure unit 14 and the water injection unit can be used, as described below. The operation of the vacuum unit 8 is stopped, and then the switch valve 21 is switched to increase the internal pressure of the inner tube 5 by the pressure unit 14. In addition, the operation of the pump unit 9 is stopped, and the pressure injection of water in the inner tube 5 is carried out by the water injection unit 15. Thereby, it is possible to clean clogging in filter members 16 around the outer tube 3 and at the water-passing portion 2. Thus, when the cleaning operation for the filter members is finished, and then the switch valve is switched to perform the groundwater pumping operation, as described above, it is possible to smoothly collect groundwater and efficiently pump groundwater. Therefore, it is preferred to alternately repeat the pumping operation and the cleaning operation. The pressure unit 14 and the water injection unit 15 explained in this embodiment are available for the groundwater pumping apparatuses of the other embodiments described above.

The invention claimed is:

1. A groundwater pumping apparatus comprising:

an outer tube buried in ground, which has a water-passing portion at its lower part;

an inner tube having a substantially same length as said outer tube and placed in said outer tube such that said inner tube is spaced from said outer tube, said inner tube having a groundwater inlet at its bottom end, which is provided at a position lower than a top end of said water-passing portion;

a shield member configured to shield top ends of said outer tube and said inner tube;

a vacuum unit configured to reduce a pressure in said inner tube;

a pump unit configured to pump groundwater that comes in said inner tube through said groundwater inlet;

a pressure unit configured to increase the pressure in said inner tube; and a water injection unit configured to carry out a pressure injection of water in said inner tube.

2. The groundwater pumping apparatus as set forth in claim 1, wherein said outer tube has a plurality of water-passing portions formed in an axial direction of said outer tube.

3. The groundwater pumping apparatus as set forth in claim 1, wherein said groundwater inlet is formed in a bottom end surface of said inner tube and placed at a position slightly higher than the bottom end of said outer tube, and said inner tube has an air inlet composed of at least one slit for air vent having an elongate shape, and said slit is formed in a side surface of the bottom end of said inner tube so as to extend in an axial direction of said inner tube, and said air inlet is formed to extend from said groundwater inlet to a position lower than the top end of said water-passing portion.

4. The groundwater pumping apparatus as set forth in claim 3, wherein an aperture amount of a lower part of said air inlet is larger than the aperture amount of its upper part.

5. The groundwater pumping apparatus as set forth in claim 4, further comprising a pressure detecting unit configured to detect the pressure in said inner tube, and a pumping-amount adjusting unit configured to adjust a pumping amount.

6. The groundwater pumping apparatus as set forth in claim 1, wherein said groundwater inlet is formed in a bottom end surface of said inner tube and placed at a position slightly higher than the bottom end of said outer tube, and said inner tube has an air inlet composed of a plurality of holes for air vent, and said holes are formed in a side surface of the bottom end of said inner tube so as to be arranged in an axial direction of said inner tube, and said air inlet is formed to extend from said groundwater inlet to a position lower than the top end of said water-passing portion.

7. The groundwater pumping apparatus as set forth in claim 6, wherein an aperture amount of a lower part of said air inlet is larger than the aperture amount of its upper part.

8. The groundwater pumping apparatus as set forth in claim 7, further comprising a pressure detecting unit configured to detect the pressure in said inner tube, and a pumping-amount adjusting unit configured to adjust a pumping amount.

* * * * *